US007594657B2

(12) United States Patent
Yraceburu et al.

(10) Patent No.: US 7,594,657 B2
(45) Date of Patent: Sep. 29, 2009

(54) MEDIUM PRESSING GUIDE

(75) Inventors: Robert M. Yraceburu, Camas, WA (US); Bryan F. Bihimaier, Vancouver, WA (US); Stephen J. McNally, Camas, WA (US); Jason S. Belbey, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 102 days.

(21) Appl. No.: 11/669,484

(22) Filed: Jan. 31, 2007

(65) Prior Publication Data

US 2008/0179828 A1 Jul. 31, 2008

(51) Int. Cl.
*B65H 5/02* (2006.01)
*B65H 5/04* (2006.01)

(52) U.S. Cl. ..... 271/275; 271/276; 271/264; 271/302; 271/303

(58) Field of Classification Search ..... 271/275, 271/276, 264, 302, 303
See application file for complete search history.

(56) References Cited

U.S. PATENT DOCUMENTS 4,056,263 A * 11/1977 LaWhite et al. ..... 271/3.2
4,202,542 A * 5/1980 Lammers et al. ..... 271/276
4,357,870 A * 11/1982 Rudolph et al. ..... 101/246
4,437,659 A 3/1984 Caron et al.
4,508,330 A * 4/1985 Jorss ..... 271/33
4,550,999 A * 11/1985 Anderson ..... 399/305
4,660,825 A * 4/1987 Umezawa ..... 271/276
5,217,220 A * 6/1993 Carlson et al. ..... 271/303
5,355,156 A * 10/1994 Balzeit et al. ..... 346/138
5,500,726 A 3/1996 Aoyama et al.
5,617,197 A 4/1997 Kawabata et al.
5,623,720 A 4/1997 Howe et al.
5,659,863 A 8/1997 Kawabata et al.
5,734,404 A * 3/1998 Komuro et al. ..... 347/104
5,820,275 A 10/1998 Crawford et al.
5,913,511 A * 6/1999 Miyauchi ..... 271/9.09
5,921,546 A * 7/1999 Herman ..... 271/270
5,953,985 A * 9/1999 Kobayashi ..... 101/116
5,971,393 A * 10/1999 Vernackt ..... 271/276
6,050,683 A 4/2000 Nuita et al.
6,092,894 A 7/2000 Nuita et al.
6,658,229 B2 12/2003 Ando et al.
2001/0024588 A1 9/2001 Baek et al.
2005/0012265 A1* 1/2005 Berlingen et al. ..... 271/276
2006/0181013 A1* 8/2006 Kondo et al. ..... 271/264
2007/0096391 A1* 5/2007 Belbey et al. ..... 271/275

FOREIGN PATENT DOCUMENTS

JP 57-123079 7/1982

OTHER PUBLICATIONS

International Search Report for Application No. PCT/US2008/050754. Report issued Apr. 29, 2008.

* cited by examiner

*Primary Examiner*—Patrick H Mackey
*Assistant Examiner*—Prasad V Gokhale

(57) ABSTRACT

Various embodiments and methods relating to a guide for pressing a medium towards a surface of a drum and for retracting the guide away from the surface are disclosed.

13 Claims, 9 Drawing Sheets

MEDIUM PRESSING GUIDE

BACKGROUND

A drum is sometimes used to transport a medium. Insufficient retention of the medium against the drum during transport may result in incorrect positioning of the medium on the drum or in the medium catching upon structures adjacent drum during its rotation.

DETAILED DESCRIPTION OF THE EXAMPLE EMBODIMENTS

Figure 1:
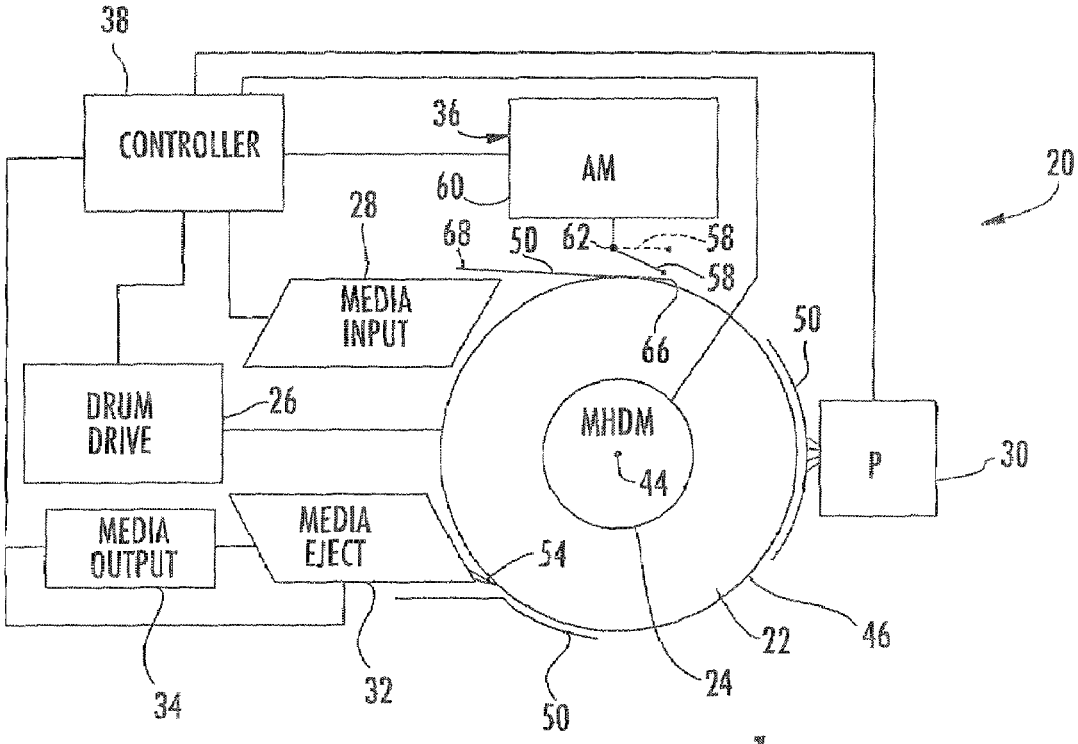
FIG. 1 is a schematic illustration of a printing system according to an example embodiment.

FIG. 1 schematically illustrates printing system 20 according to an example embodiment. Printing system 20 is configured to print or deposit material onto a medium supported by a drum 22. As will be described in more detail hereafter, printing system 20 loads media onto the drum such that the media is securely retained against the drum during transport and printing.

Printing system 20 generally includes media transport drum 22, media hold-down mechanism 24, drum drive 26, media input 28, printing mechanism 30, media eject 32, media output 34, load assist system 36 and controller 38. Media transport drum 22 may comprise a large, generally cylindrical member configured to be rotationally driven about axis 44 and includes a media support surface 46. Media support surface 46 comprises a generally circumferential surface upon which one or more pieces or sheets 50 of a medium, such as a cellulose-based material, polymer-based material, metallic-based material or combinations thereof, may be held or retained during printing and/or other interaction. In one embodiment, surface 46 may include elongated circumferential grooves or depressions (not shown) to facilitate separation of sheets from surface 46. In the particular embodiment illustrated, surface 46 is configured to retain at least three 8.5 inch by 11 inch sheets of the medium. In other embodiments, surface 46 may be configured to support a fewer or greater of the same sheets or larger or smaller sheets.

Media hold-down mechanism 24 comprises a mechanism configured to hold and retain sheets 50 against surface 46 during rotation of drum 22 about axis 44. In one embodiment, media hold-down mechanism retains sheets 50 against surface 46 in a continuous fashion as sheets 50 are transported from load assist system 36, past printing mechanism 30 and to media eject 32. In other embodiments, this retention may be periodic or discontinuous. In one embodiment, media hold-down mechanism 24 includes perforations or other openings along surface 46 through which a vacuum from a vacuum source is applied to retain sheets 50 against surface 46. In still other embodiments, media hold-down mechanism 24 may be configured to create electrostatic charge (or force) along surface 46 to retain one or more of sheets 50 against surface 46. In particular embodiments, media hold-down mechanism 24 may use both electrostatic forces and vacuum forces to hold sheets 50 against surface 46. Yet in other embodiments, media hold-down mechanism 24 may be configured to retain sheets 50 against surface 46 in other fashions.

Drum drive 26 (schematically shown) comprises a device configured to rotationally drive drum 22 about axis 44 so as to move one or more sheets 50 from media input 28 to printing mechanism 30 and ultimately to media eject 32. In one embodiment, drum drive 26 comprises an electric motor operably coupled to drum 22 by a transmission or other power train. In other embodiments, drum drive 26 may comprise other devices configured to provide torque to rotate drum 22.

Media input 28 (schematically shown) comprises a mechanism configured to supply and transfer sheets 50 of media to drum 22. In one embodiment, media input 28 may include a media storage volume, such as a tray, bin and the like, one or more pick devices (not shown) configured to pick a sheet of media from the storage volume and one or more media transfer mechanisms configured to transfer the medium to drum 22. Media input 28 may have a variety of sizes and configurations.

Printing mechanism 30 (schematically shown) comprises a mechanism or device configured to print or otherwise deposit materials upon sheet 50. In one embodiment, printing mechanism 30 may be configured to print a pattern or image upon sheets 50 as sheets 50 are held against surface 46 of drum 22. In one embodiment, printing mechanism 30 may be configured to eject fluid ink onto sheets 50 held by drum 22. In one embodiment, printing mechanism 30 may include one or more print heads carried by one or more carriages that are configured to be scanned across sheets 50 of media held by drum 22 and directions generally along an axis 44. In other embodiments, printing mechanism 30 may include print heads which substantially extend across a width or dimension of sheets 50 held by drum 22 such as with a page-wide-array printer. In still other embodiments, printing mechanism 30 may comprise other printing devices configured to deposit ink, toner or other materials upon sheets 50 held by drum 22 in other fashions.

Media eject 32 (schematically shown) comprises a mechanism configured to eject or separate sheets 50 from surface 46 of drum 22 and to transfer such removed sheets to media output 34. In one embodiment, media eject 32 includes claw 54 (or several claws 54 aligned along the axis of drum 22, or at regular or irregular intervals along the width of sheets 50) extending into close proximity with surface 46, wherein the claw 54 assists in lifting and guiding a sheet away from surface 46. In one embodiment, claw 54 is movable between a media ejecting position (shown) and a retracted position. In the retracted position, claw(s) 54 is separated from surface 46, permitting the sheet 50 to pass media eject 32 and to continue to be transported about axis 44 for further printing or other interaction. In other embodiments, claw(s) 54 may be stationarily retained in the ejecting position wherein sheets 50 are not permitted to make multiple passes. In other embodiments, claw(s) 54 may be omitted where other mechanisms are used to separate sheet 50 from surface 46 of drum 22. In one embodiment, such separation of sheet 50 from surface 46 may further be assisted by pressurized air provided through ports (not shown) along surface 46

Media output 34 comprises a mechanism or device configured to transport sheets 50 separated from drum 22 by media eject 32 to one or more locations for further interaction with such removed sheets or for output to a user of printing system 20. For example, in one embodiment, media output 34 may be configured transport such ejected sheets of media to a duplexer and back to media input 28 for two sided printing. In still other embodiments, media output 34 may be configured to transport such ejected sheets for receipt by a user of printing system 20.

Load assist system 36 comprises one or more components configured to selectively urge a sheet 50 being loaded from media input 28 towards surface 46 of drum 22. In particular, load assist system 36 assists bending of the sheet 50 towards surface 46 about axis 44 such that gaps or spaces between sheet 50 and surface 46 are reduced and such that the sheet is more securely retained against surface 46. For example, in embodiments were media hold-down mechanism 24 utilizes a vacuum to hold sheets 50 against surface 46, load assist system 36 reduces potential leaks along the edges of sheet 50 such that the sheet 50 is held with a greater vacuum force. In embodiments where media hold-down mechanism utilizes electrostatic forces, a greater area of sheet 50 is electrostatically held against surface 46. Because load assist system 36 is selectively movable with respect to drum 22, system 36 may be moved further away and out of engagement with surface 46 when not being used to reduce wear against surface 46 and to permit sheets 50 to move past system 36 during a second or subsequent pass with a reduced likelihood of system 36 smearing or undesirably contacting deposited material upon sheet 50.

Load assist system 36 includes guide 58 and actuation mechanism 60. Guide 58 (schematically shown) comprises a structure movable between the first media pressing position (shown in solid lines) and a second retracted position (shown in broken lines). In the media pressing position, guide 58 is configured to press or urge sheet 50 towards surface 46. In one embodiment, guide 58 is configured to contact a face of sheet 50 such that the opposite face of sheet 50 is in contact with face 46. In another embodiment, guide 58 may alternatively be configured to move sheet 50 into close proximity to surface 46, wherein media hold-down mechanism 24 further draws sheet 50 into contact with surface 46 and out of contact with guide 58. In particular embodiments, guide 58 may be movable between various media pressing positions which have different proximities to surface 46 depending upon a sensed or input thickness or stiffness of sheet 50.

In the retracted position, guide 58 is retracted or withdrawn from surface 46. Guide 58 is retracted further from surface 46 than when guide 58 is in the media pressing position. In one embodiment, guide 58 is spaced from surface 46 in the retracted position by a distance sufficient such that media held against surface 46 and having a thickness of up to about 1 mm may pass beneath guide 58 without being contacted by guide 58. In one embodiment, in the retracted position, guide 58 permits access to media input 28 or drum 22 to facilitate removal of media sheet jams or correction of other issues. For example, in one embodiment, guide 58, in the retracted position, is spaced from surface 46 by a distant radially extending from axis 44 by a distance of at least 30 mm. In one embodiment, guide 58 is movable between a plurality of different retracted positions spaced from surface 46 by different extents. For example, guide 58 may be movable between a first retracted position in which guide 58 is ready to be quickly actuated to the media pressing position just prior to receipt of sheet 50, a second retracted position sufficiently spaced from surface 46 such that a first media sheet 50 at a first thickness may pass without contact with guide 58, a third retracted position sufficiently spaced from surface 46 such that a second media sheet 50 having a second greater thickness may pass without contact with guide 58 and a fourth retracted position sufficiently spaced from surface 46 permitting media jams to be cleared or access to portions of drum 22 or media input 28.

In the particular example illustrated, guide 58 pivots between the media pressing position and the retracted position. In other embodiments, guide 58 may alternatively linearly or arcuately move along surface 46, wherein one or more cams or ramps are employed for moving (raising and lowering) guide 58 towards and away from surface 46 in response to such linear or arcuate translation.

Actuation mechanism 60 comprises a mechanism configured to move guide 58 between the one or more media pressing positions and the one or more retracted positions. In one embodiment, actuation mechanism 60 is configured to selectively pivot guide 58 about axis 62. As noted above, in other embodiments, actuation mechanism 60 may alternatively be configured to raise or lower guide 58 with respect to surface 46 in other fashions.

According to one embodiment, actuation mechanism 60 is configured to move guide 58 between the media pressing position and the retracted position based upon an angular positioning of circumstantial surface 46. In one embodiment, actuation mechanism 60 actuates or moves guide 58 based upon control signals received from controller 38 which are based upon sensed rotation of drum 22. For example, in one embodiment, encoders or sensors may be associated with drum 22 or drum drive 26, wherein controller 38 generates control signals controlling the operation of actuation mechanism 60 based upon such sensed values. In another embodiment, actuation mechanism 60 may be directly connected to a sensor which senses angular positioning of drum 22. In still another embodiment, actuation mechanism 60 may include a cam follower engaged with a cam that rotates with the rotation of drum 22, wherein actuation mechanism 60 moves guide 58 based upon that interaction of the cam and the cam follower.

Controller 38 comprises one or more processing units configured to generate control signals directing the operation of media hold-down mechanism 24, drum drive 26, media input 28, printing mechanism 30, media eject 32, media output 34 and actuation mechanism 60. In embodiments where actuation mechanism 60 is actuated directly and automatically in response to the angular positioning of drum 22, actuation mechanism 60 may alternatively operate independently of controller 38.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 38 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, in response to receiving a print command, controller 38 generates control signals directing media input 28 to initiate loading of a sheet 50 onto drum 22. Controller 38 further generates control signals directing drum drive 26 to rotate from 22 about axis 44. In one embodiment, media input 28 loads sheets 50 at selected angular locations upon surface 46 or based upon angular positioning of drum 22. As the leading edge 66 of sheet 50 is moved to position generally opposite to guide 58, actuation mechanism 60 actuates guide 58 from a retracted position to a media pressing position. As a result, the leading edge 66 of sheet 50 is urged towards surface 46. This may result in bending of leading edge 66 towards surface 46 and about axis 44, Guide 58 remains in the pressing position until a trailing edge 68 of sheet 50 has been pressed and potentially bent towards surface 46, resulting in an entire longitudinal length of sheet 50 being urged into abutting contact with surface 46. As a result, sheet 50 is more securely retained against surface 46 by media hold-down mechanism 24.

In other embodiments, actuation mechanism 60 may alternatively move guide 58 to a retracted position after the leading edge 66 has been urged against surface 46 and once again move guide 58 back to the media pressing position so as to urge trailing edge 68 against surface 46. In still other embodiments, actuation mechanism 60 may alternatively move guide 58 to the media pressing position when encountering one of leading edge 66 or trailing edge 68.

Once securely positioned against drum 22, sheet 50 is further transported by drum 22 to printing mechanism 30. When sheet 50 is positioned opposite to printing mechanism 30, as detected by sensors or as determined based upon angular positioning of drum 22, controller 38 generates control signals causing printing mechanism 30 to deposit material upon sheet 50.

As further shown by FIG. 1, when printing upon sheet 50 is completed, controller 38 generates control signals directing media eject 32 to move claw(s) 54 to the ejecting position until such a sheet 50 is lifted from surface 46 and ultimately transported to media output 34. If further printing upon sheet 50 is desired or if other interactions are to be performed on sheet 50, controller 38 may generate control signals directing media eject 32 to move claw 54 to the withdrawn position, permitting sheet 50 to pass media eject 32 and to be further transported by drum 22 about axis 44. Once ejected and transported to media output 34, the printed upon sheet 50 is ready for receipt by a user.

Figure 2:
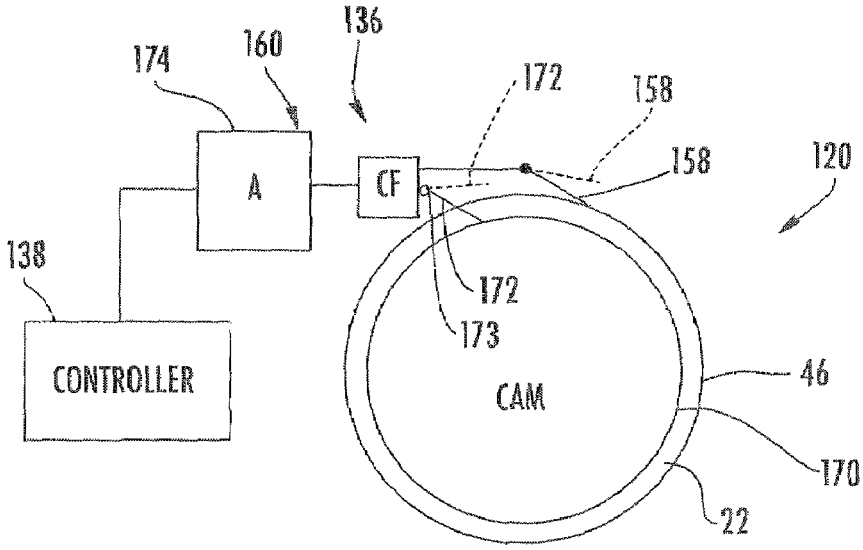
FIG. 2 is a schematic illustration of another embodiment of the printing system of FIG. 1 according to an example embodiment.

FIG. 2 schematically illustrates printing system 120, another embodiment of printing system 20. Printing system 120 is similar to printing system 20 except that printing system 120 includes load assist system 136 and controller 138 in lieu of load assist system 36 and controller 38, respectively. Like printing system 20, printing system 120 further includes drum 22, media hold-down mechanism 24, drum drive 26, media input 28, printing mechanism 30, media eject 32, and media output 34, each of which is shown and described with respect to system 20.

Like load assist system 36, Load assist system 136 comprises one or more components configured to selectively urge a sheet 50 (shown in FIG. 1) being loaded from media input 28 towards surface 46 of drum 22. In particular, load assist system 36 assists bending of the sheet 50 towards surface 46 about axis 44 such that gaps or spaces between sheet 50 and surface 46 are reduced and such that the sheet is more securely retained against surface 46. For example, in embodiments were media hold-down mechanism 24 utilizes a vacuum to hold sheets 50 against surface 46, load assist system 136 reduces potential leaks along the edges of sheet 50 such that the sheet 50 held with a greater vacuum force. In embodiments where media hold-down mechanism utilizes electrostatic forces, a greater area of sheet 50 is electrostatically held against surface 46. Because load assist system 136 is selectively movable with respect to drum 22, system 136 may be moved further away and out of engagement with surface 46 when not being used to reduce wear against surface 46 and to permit sheets 50 to move past system 136 during a second or subsequent pass with a reduced likelihood of system 136 smearing or undesirably contacting deposited material upon sheet 50.

Load assist system 136 includes a guide 158 (described above with respect to FIG. 1) and actuation mechanism 160. Actuation mechanism 160 actuates guide 158 between one or more medium pressing positions and one or more retracted positions. In the example illustrated, actuation mechanism 160 actuates guide 158 based upon the angular positioning of drum 22. In the example illustrated, actuation mechanism 160 actuates guide 158 based upon the angular positioning of drum 22 automatically in response to rotation of drum 22 without electronic sensing of the rotation of drum 22.

As shown by FIG. 2, actuation mechanism 160 includes cam 170, cam follower 172 and actuator 174. Cam 170, schematically shown, comprises one or more cam surfaces operably coupled to (and nominally directly coupled) to drum 22 so as to rotate with drum 22. In one embodiment, cam 170 rotates about axis 44 with drum 22. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Cam follower 172 comprises one or more members coupled to guide 158 and configured to interact with cam 170 during rotation of cam 170 such that guide 158 automatically moves between a media pressing position and a retracted position in response to interaction between cam 170 and cam follower 172. For example, upon engaging selected zones or portions of cam 170, cam follower 172 transmits force to guide 158 to move guide 158 to the retracted position. Upon engaging other selected zones or portions of cam 170, cam follower 172 will transmit force to guide 158 so as to move and retain guide 158 in the media pressing position. Such movement between the media pressing position and at least one retracted position occurs without other sensing of the rotation of drum 22. In the particular embodiment illustrated, such movement of guide 158 occurs without other power trains or motors driving movement of guide 158. As a result, system 120 is less complex and potentially less expensive.

In the particular embodiment illustrated, as shown in FIG. 2, cam follower 172 is selectively movable between a cam engaged state (shown in solid lines) and a cam disengaged state (shown in broken lines). In the cam engaged state, cam follower 172 is in engagement with cam 170 such that positioning of guide 158 (media pressing position or retracted position) is dependent or may be dependent upon the particular portion of cam 170 in engagement with cam follower 172. In the cam disengaged state, cam follower 172 is out of engagement with cam 170 such that the positioning of guide 158 is also independent of cam 170. In the particular example illustrated, when cam follower 172 is in the cam disengaged state, guide 158 is in a retracted position. As a result, regardless of the angular positioning of drum 22 and cam 170, guide 158 is in a retracted position. In the particular embodiment illustrated, cam follower 172 is further configured such that cam follower 172 may be moved to one of a plurality of cam disengaged states wherein guide 158 also moves to one of a plurality of different retracted positions in response to movement of cam follower 172.

Actuator 174 comprises a device configured to selectively actuate or move cam follower 172 between the cam engaged state and at least one cam disengaged state. In the example illustrated, actuator 174 is configured to pivot a portion of cam follower 172 about axis 173. In another embodiment, actuator 174 may be configured to move cam follower 172 in other fashions.

In one embodiment, actuator 174 comprises a motor and power train configured to transmit torque to cam follower 172 to move cam follower 172. In one embodiment, actuator 174 is configured to move cam follower 172 between the states depending upon a direction of torque supplied by the motor of actuator 174. In other embodiments, actuator 174 may alternatively be other power sources such as hydraulic, pneumatic or electrical power sources. For example, a solenoid may alternatively be used to move cam follower 172.

Controller 138 is similar to controller 38 in that controller 138 comprises one or more processing units which generate control signals directing the operation of media hold-down mechanism 24, drum drive 26, media input 28, printing mechanism 30, media ejector 32, media output 34 (shown in FIG. 1) and actuation mechanism 160. In embodiments where cam follower 172 remains in engagement with cam 170, actuation mechanism 160 may alternatively operate independently of controller 138. Controller 138 is different from controller 38 in that controller 138 may operate following a different set of control instructions contained in a memory. In particular, controller 138 is configured to generate control signals directing actuator 174 to move cam follower 172 between the cam engaged state and one or more cam disengaged states based upon a sensed or known angular positioning of drum 22, or based upon other sensed information, such as the occurrence of a media jam or based upon commands received from a user.

In operation, according to one embodiment, controller 138 generates control signals directing actuator 174 to move cam follower 172 to a cam engaged state as or just prior to the loading of a sheet 50 by media input 28 (shown in FIG. 1). Shortly thereafter, a first portion of cam 170 is rotated into engagement with cam follower 172. Such interaction causes cam follower 172 to move and thereby causes guide 158 to move from a retracted position to a media pressing position (shown in solid lines). As a result, the sheet 50 of media is pressed towards the surface 46, enhancing the ability of media hold-down mechanism 24 to retain a sheet 50 against surface 46. After the trailing edge 68 of sheet 50 has passed guide 158 a different second portion of cam 170 may be rotated into engagement cam follower 172. In other embodiments, the second portion of cam 170 is rotated into engagement with cam follower before the trailing edge 68 of sheet 50 has passed guide 58. This interaction causes movement of cam follower 172 and responsive movement of guide 158 to a first retracted position, ready for assisting with loading of a subsequent sheet 50.

In certain circumstances, it may be desirable to move a particular sheet through multiple passes across printing mechanism 30 for enhanced resolution or application of multiple overlying layers of print material. In such an example scenario, controller 138 may generate control signals causing actuator 174 to move cam follower 172 to a cam disengaged state. As a result, guide 158 remains in the retracted position as a second portion of cam 170 moves beneath cam follower 172. Consequently, a sheet may be moved past guide 158 without interaction with guide 158. Thus, there is a reduced likelihood of guide 158 smearing or otherwise undesirably contacting material deposited upon sheet 50.

In certain circumstances, sheet 50 may become jammed or access to media input 28 or portions of drum 22 may be desired. In one embodiment, controller 138 may additionally be configured to generate control signals causing actuator 174 to move cam follower 172 to an additional retracted state in which cam follower 172 is spaced further from cam 170. Because cam follower 172 is coupled to guide 158, such movement of cam follower 172 results in guide 158 being moved to a retracted position even further away from surface 46. In other embodiments, controller 138 may alternatively be configured to generate control signals causing actuator 174 to move cam follower 172 to a fewer or greater of such states or positions.

Figure 3:
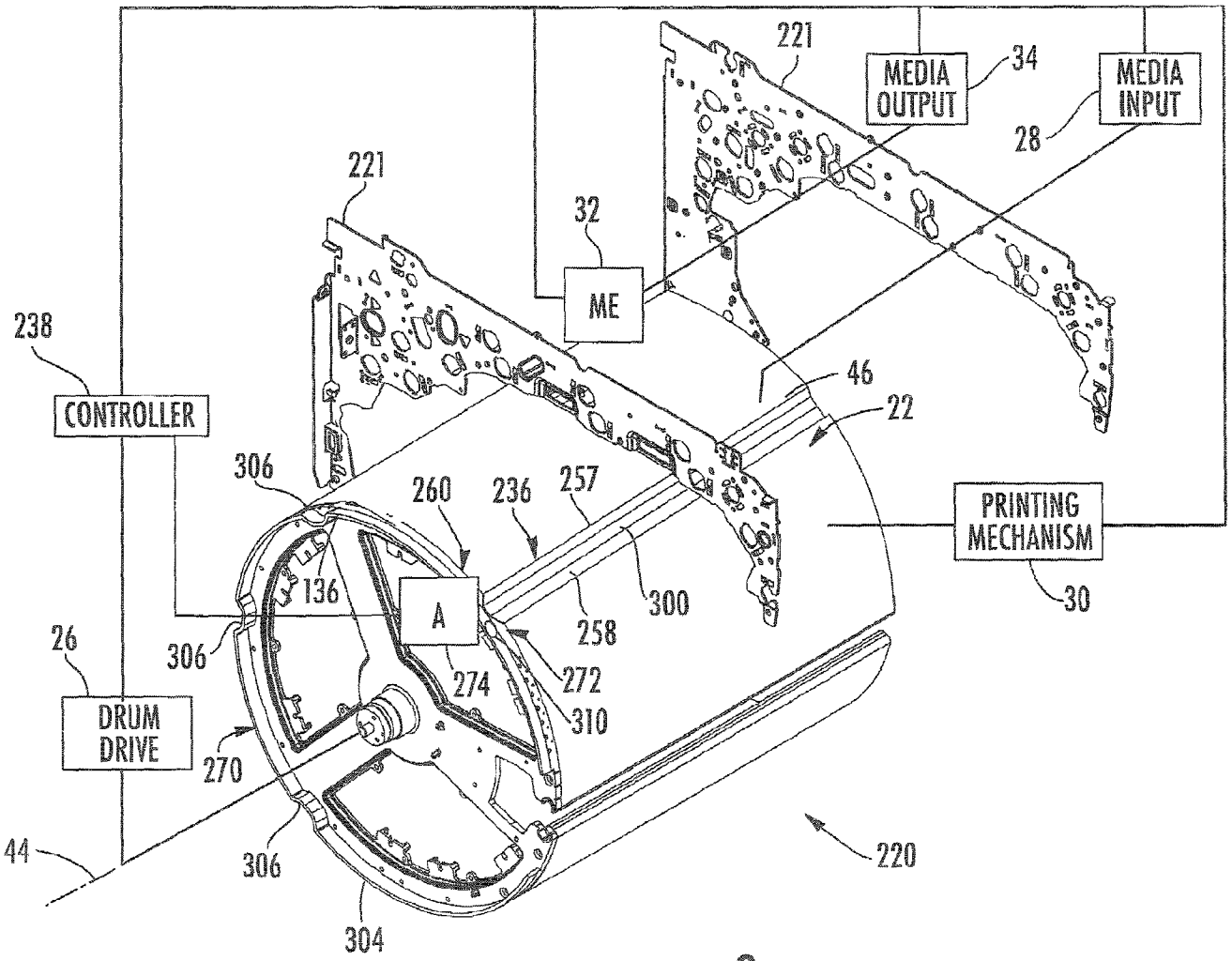
FIG. 3 is a top perspective view of another embodiment of the printing system of FIG. 1 with portions schematically shown according to an example embodiment.

FIG. 3 illustrates printing system 220, another embodiment of printing system 20. Printing system 220 is configured to print or deposit material onto a medium supported by a drum 22. As will be described in more detail hereafter, printing system 220 loads media onto the drum 22 such that the media is more securely retained against the drum during transport and printing.

Printing system 220 generally includes frame 221, media transport drum 22, media hold-down mechanism 24 (shown in FIG. 1), drum drive 26, media input 28, printing mechanism 30, media eject 32, media output 34, load assist system 236 and controller 238. Drum 22, media hold-down mechanism 24, drum drive 26, media input 28, printing mechanism 30, media eject 32 and media output 34 are each described above with respect to system 20. Frame 221 comprises one or more structures proximate to drum 22 configured to support components of printing system 220. Although illustrated as including two parallel plates, frame 221 may have various other sizes and configurations and may support fewer or additional components of printing system 220.

Load assist system 236 is similar to load assist system 136 shown and described with respect to FIG. 2. Load assist system 236 includes guide bar 257, guide 258 and actuation mechanism 260. Guide bar 257 comprises an elongate shaft, rod or cylinder operably coupled between actuation mechanism 260 and guide 258. Guide bar 257 supports guide 258 such that rotation of guide bar 257 results in pivoting of guide 258. In the particular embodiment illustrated, guide bar 257 is further configured to assist in engaging and directing a sheet of media towards surface 46 prior to the sheet of media being encountered by guide 258. In one embodiment, guide bar 257 is spaced from circumferential surface 46 by less than or equal to about 2 mm.

Like guide 58, guide 258 comprises a structure movable between the first media pressing position (shown in FIGS. 7-9) and one or more retracted positions (shown in FIGS. 4 and 10-13). As shown in FIG. 3, in the particular embodiment illustrated, guide 258 continuously and without interruption extends axially across substantially an entirety of those portions of surface 46 adapted to bear against, contact and support a medium. In one embodiment, guide 258 continuously and without interruption axially extends across substantially all of surface 46 and drum 22. In other embodiments, guide 258 may extend across lesser portions of drum 22. In other embodiments, guide 258 may include multiple segments or fingers axially spaced from one another along drum 22. In such an embodiment, the multiple segments or fingers could be independently actuated.

According to one embodiment, guide 258 comprises a band or strip of material configured to flex upon engaging a sheet of medium which is also in contact with surface 46. As a result, guide 258 assumes a slightly bent or arcuate shape to conform to surface 46 which is curved. Consequently, a greater portion of a sheet 50 may be concurrently contacted by both surface 46 and guide 58 for enhanced pressing of the sheet against surface 46. In other embodiments, guide 258 may be inflexible.

According to one embodiment, guide 258 comprises a strip of thin sheet metal. In other embodiments, guide 258 may comprise other somewhat flexible materials. As shown in FIG. 3, portions of guide 258 proximate to actuation mechanism 260 are stiffened by one or more stiffening supports 300. In other embodiments, such supports 300 may be omitted.

Actuation mechanism 260 actuates or moves guide 258 between the media pressing position and one or more retracted positions. In particular, actuation mechanism 260 moves guide 258 based upon angular positioning of drum 22. Like actuation mechanism 160 (shown in FIG. 2), actuation mechanism 260 includes cam 270, cam follower 272 and actuator 274.

Cam 270 comprises one or more cam surfaces directly coupled to drum 22 so as to rotate with drum 22 about axis 44. In the example illustrated, cam 270 is mounted to drum 22 on an axial end of drum 22. In other embodiments, cam 270 may be joined to drum 22 in other fashions or may be integrally formed as part of a single unitary body with drum 22. In still other embodiments, cam 270 may be provided at other locations with respect to drum 22.

As shown by FIG. 3, cam 270 comprises a substantially circumferential surface axially extending from surface 46. Cam 270 includes zones or portions 304 and zones or portions 306 (sometimes referred to as the actuation zones). Portions 304 and 306 are configured to interact with cam follower 272. Portion 304 is configured to interact with cam follower 272 such that guide 258 is moved to or retained in a retracted position. Portion 306 is configured to interact with cam follower 272 such that guide 258 is moved to or retained in a media pressing position. In the example illustrated, portion 304 comprises generally continuous convex arcuate portions extending between portions 306. Portion 306 comprise craters or cavities into which cam follower 272 moves when encountering portions 306.

In the particular example embodiment illustrated, portion 306 are located so as to overlap and extend adjacent to those portions of surface 46 against which the leading edge and the trailing edge of a sheet are to be loaded. According to one embodiment, portion 306 are located such that guide 258 is moved to the media pressing position so as to contact surface 46 approximately 6 mm ahead of an oncoming leading edge 66 of a sheet 50 (shown in FIG. 1). In the particular example illustrated, each portion 306 has a circumferential length of approximately 2.6 cm. In other embodiments, portions 306 and portions 304 may have other circumferential extents. In addition, cam 270 may have a greater or fewer of such portions 306.

Cam follower 272 interacts with cam 270. In the example illustrated, cam follower 272 comprises a rotational tire or wheel 310 which rolls against cam 270 during rotation of drum 22 and cam 270. In other embodiments, cam follower 272 may comprise other structures configured to slide or bear against cam 270 during rotation of drum 22. Cam follower 272 is operably coupled to guide 258 such that movement of cam follower 272 may also result in movement of guide 258.

Actuator 274 comprises a device configured to move cam follower 272 between a cam engaged state and one or more cam disengaged states. In the embodiment illustrated, when actuator 274 moves cam follower 272 between different cam disengaged states, actuator 274 also moves guide 258 between different retracted positions. Actuator 274 moves cam follower 272 between the cam engaged state and one or more cam disengaged states in response to control signals from controller 238.

Figure 4:
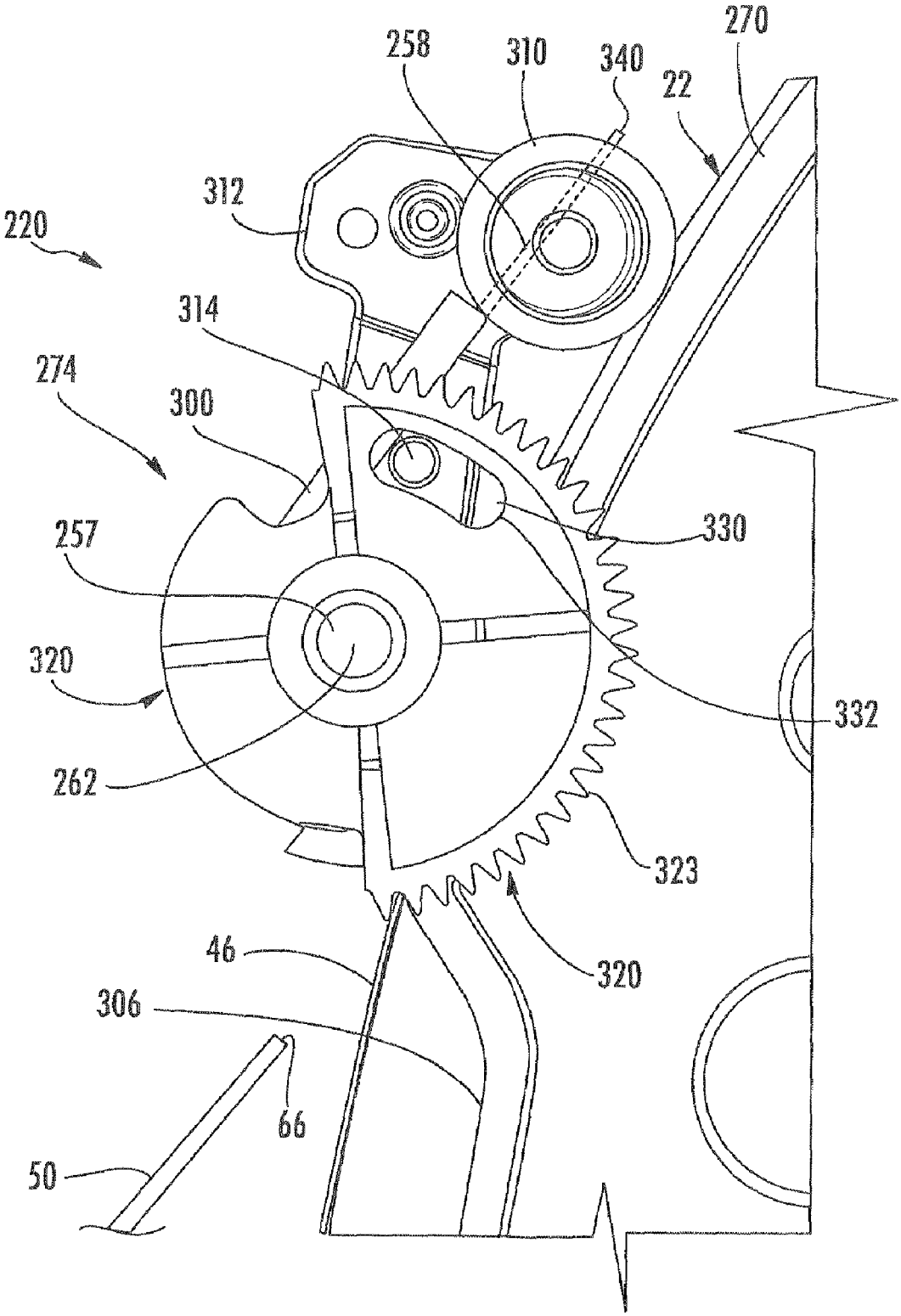
FIG. 4 is an enlarged fragmentary side elevational view of the printing system of FIG. 3 illustrating a cam follower in a cam engaged state and a guide in a retracted position according to an example embodiment.
Figure 5:
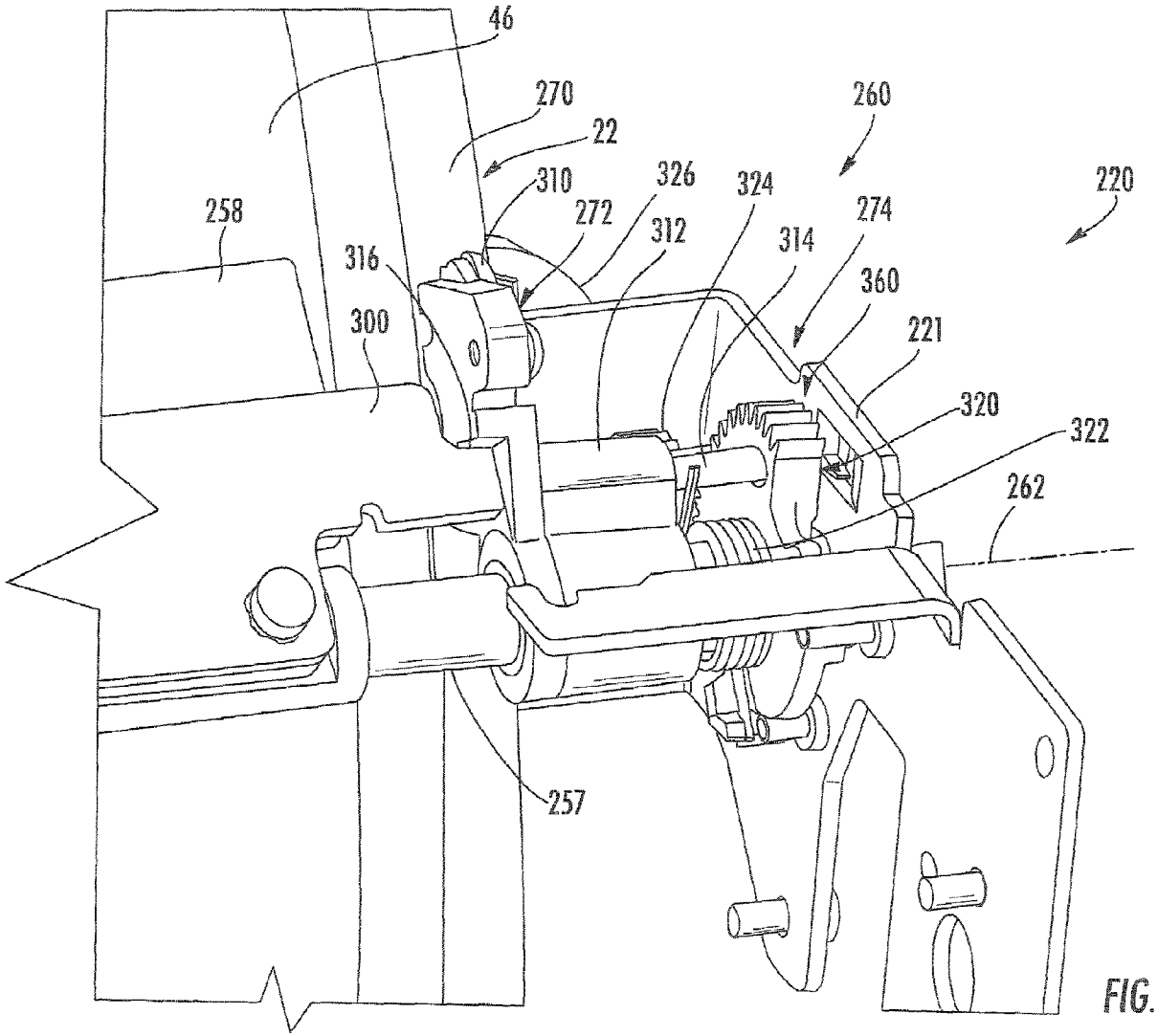
FIG. 5 is an enlarged fragmentary perspective view of the portion of the printing system of FIG. 4 according to an example embodiment.
Figure 6:
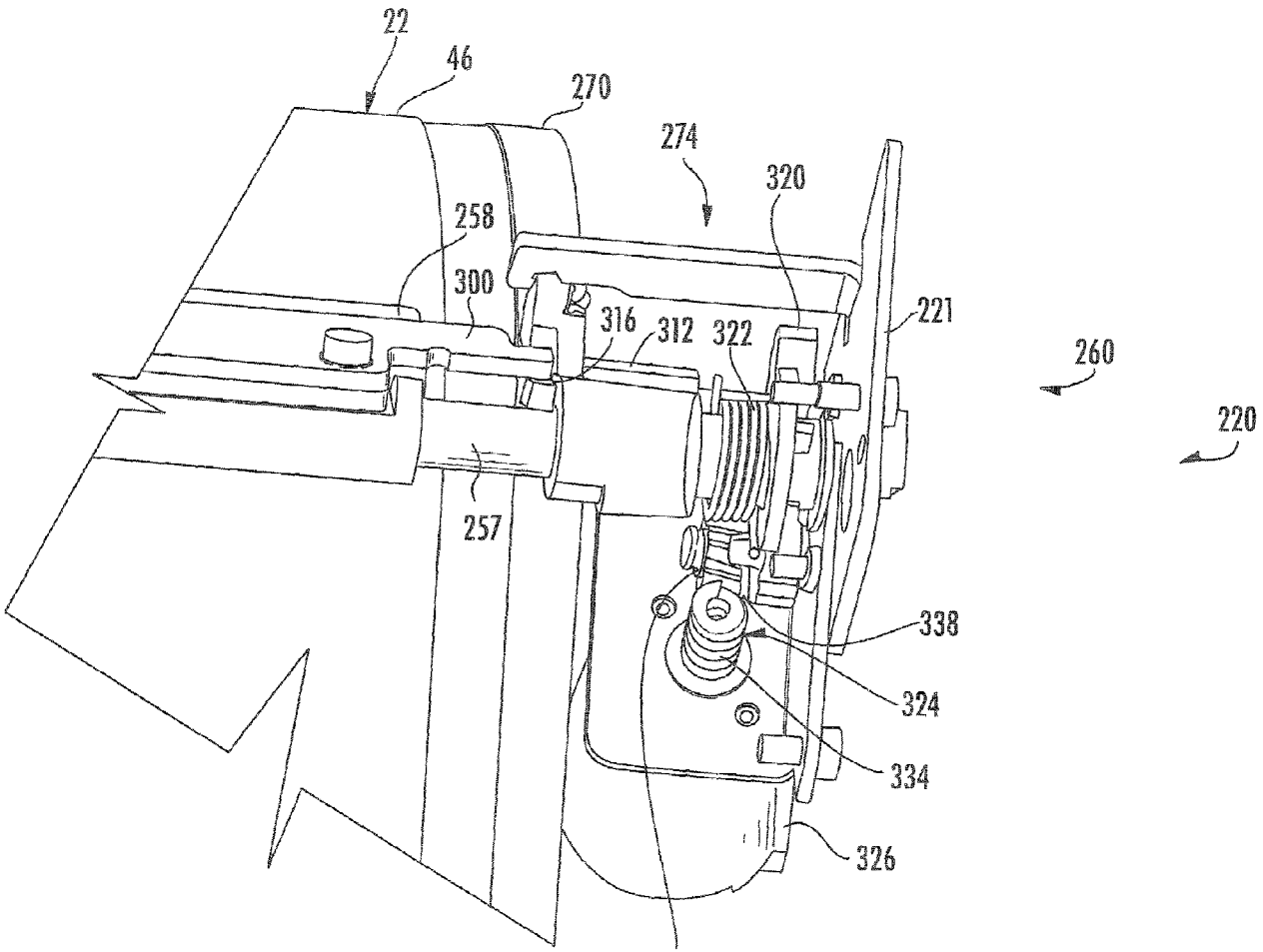
FIG. 6 is another enlarged fragmentary perspective view of the portion of the printing system of FIG. 4 according to an example embodiment.

FIGS. 4-6 illustrate portions of system 220, including cam follower 272 and actuator 274, in detail. As shown by FIGS. 4-6, cam follower 272 includes wheel 310, arm 312 and pin 314. Wheel 310 rotates along cam 270 and is rotationally supported by arm 312. Arm 312 is rotationally journaled to frame 221 so as to rotate about axis 262. As shown by FIG. 5, arm 312 is connected to guide bar 257 which is connected to guide 258. Arm 312 further includes a support surface 316 in abutment with stiffening support 300. As a result, arm 312 may apply a greater torque to media guide bar 257 to pivot guide 258 about axis 262. Pin 314 projects from arm 312 and interacts with portions of actuator 260, facilitating movement of arm 312 and wheel 310 of cam follower 272 between the cam engaged state and cam disengaged states.

Actuator 274 comprises a mechanism configured to selectively move wheel 310 of cam follower 272 between the cam engaged state and cam disengaged states. In the particular example illustrated, actuator 274 includes rotational structure 320, bias 322, drive train 324 and rotary actuator 326. Rotational structure 320 comprises a structure rotationally coupled to frame 221 and journaled guide bar 257 along an axis 262. In other words, rotational structure 320 is configured to rotate about axis 262 relative to guide bar 257 and relative to frame 221. Rotational structure 320 is configured to be operably coupled to rotary actuator 326 so as to be rotationally driven in either direction about axis 262 by rotary actuator 326. In the particular embodiment illustrated, rotational structure 320 includes a gear having teeth 323 configured to be in engagement with drive train 324. In other embodiments, rotational structure 320 may be configured to be operably coupled to rotary actuator 326 in other fashions. For example, in other embodiments, rotational structure 320 may comprise a pulley, wherein torque is transmitted to rotational structure 324 by a belt or rotational structure 320 may comprise a sprocket, wherein torque is transmitted to rotational structure 320 by a chain. In still other embodiments, rotational structure 320 may be rotationally driven in either direction by means of a linear actuator pivotally connected to a portion of rotational structure 320. In yet another embodiment, the rotational structure may be driven by a connecting rod, such as is used with servo motors.

As shown by FIG. 4, rotational structure 320 includes a detent in the form of a slot 330 receiving pin 314, serving as a projection. Slot 330 is sufficiently sized such that arm 312 of cam follower 272 may pivot about axis 262 when wheel 310 is in engagement with portion 306 a sufficient extent to rotate media guide bar 257 and guide 258 about axis 262 to press a sheet 50 a sufficient distance towards surface 46 of drum 22. In one embodiment, slot 330 extends approximately 30 degrees about axis 262 and has a length of about 8 mm while portions 306 have a depth of about 7 mm. In other embodiments, these dimensions may vary.

In addition to permitting pivoting arm 312 and wheel 310 when cam follower 272 is in the cam engaged state as shown in FIG. 4, slot 330 further provides a driving surface 332 configured to abut and engage pin 314 upon rotation of rotational structure 320 in a counter-clockwise direction (as seen in FIG. 4). During such rotation, surface 332 drives pin 314 to pivot arm 312 and wheel 310 of cam follower 272 about axis 262 to move cam follower 272 to a cam disengaged state. Depending upon the extent to which rotational structure is rotated in the counter-clockwise direction as seen in FIG. 4, wheel 310 may be pivoted to a multitude of different cam disengaged states. Likewise, guide 258 may also be moved to any of a multitude of retracted positions having different spacings with respect to surface 46.

Although rotational structure 320 is illustrated as including a slot 330 receiving pin 314, in other embodiments, arm 312 and rotational structure 320 may be similarly engaged in other fashions. For example, arm 312 may alternatively include a slot while rotational structure 320 includes a pin. In another embodiment, arm 312 and rotational structure 320 may alternatively include mutually opposing surfaces, such as mutually opposing tabs. In still other embodiments, arm 312 and rotational structure 320 may have other configurations providing similar interactions.

As shown by FIGS. 5 and 6, bias 322 comprises a biasing structure configured to resiliently urge arm 312 towards a cam engaged state. In the particular embodiment illustrated, bias 322 comprises a torsion spring coupled between rotational structure 322 and pin 314. In other embodiments, bias 322 may comprise other resiliently biasing mechanisms or springs.

Drive train 324 is configured to transmit torque from rotary actuator 326 to rotational structure 320. In the particular embodiment illustrated, drive train 324 includes a worm gear 334, a helical gear 336 and a spur gear 338. Worm gear 334 is connected to an output shaft of rotary actuator 326. Helical gear 336 is in engagement with worm gear 334 and is fixed to rotate with spur gear 338. Spur gear 338 is in engagement with teeth 323 of rotational structure 320. In other embodiments, drive train 324 may have other configurations such as belt and pulley or chain and sprocket arrangements depending upon corresponding alternative configurations of rotational structure 320.

Rotary actuator 326 comprises a source of torque for driving worm gear 334. In the embodiment illustrated, rotary actuator 326 comprises an electric motor. Rotary actuator 326 is configured to selectively provide torque in either direction in response to control signals from controller 238.

Controller 238 is similar to controller 138. Controller 238 comprises one or more processing units configure to generate control signals directing the operation of media hold-down mechanism 24 (shown in FIG. 1), drum drive 26, media input 28, printing mechanism 30, media eject 32, media output 34 and actuator 274 of load assist system 236.

FIGS. 4 and 7-13 illustrate operation of load assist system 236. FIG. 4 illustrates load assist system 236 in a media guide activated state, wherein cam follower 272 is in the cam engaged state and wherein guide 258 is in a retracted position. In the follower releasing state of rotational structure 320 illustrated in FIG. 4, surface 332 is out of contact with pin 314 and is spaced from surface pin 314 such that arm 312 is free to rotate in a clockwise direction as seen in FIG. 4 upon wheel 310 dropping into portion 306 of cam 270.

Figure 7:
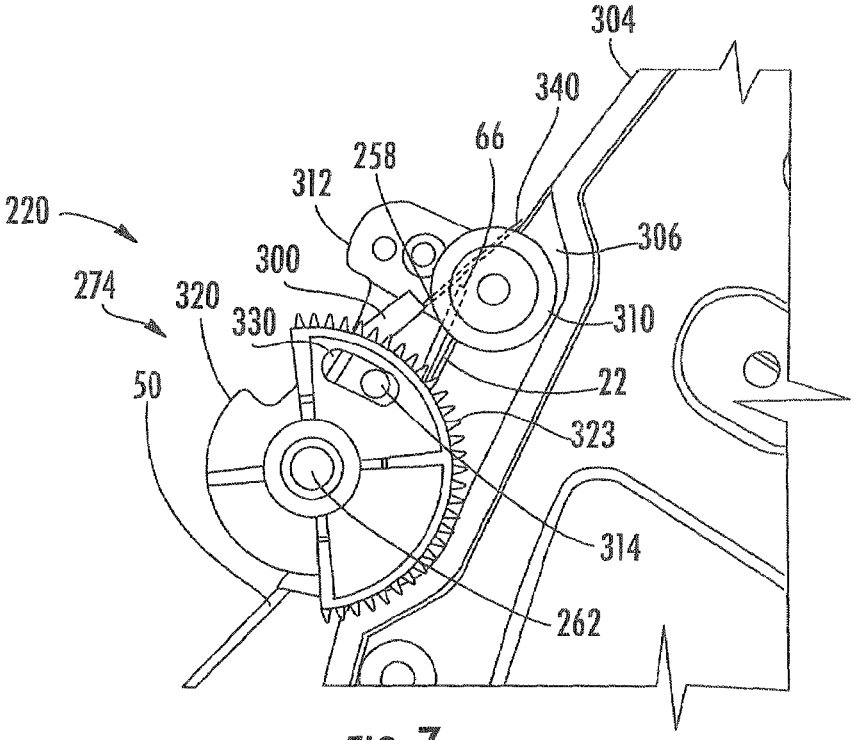
FIG. 7 is an enlarged fragmentary side elevational view of the printing system of FIG. 3 illustrating the cam follower in a cam engaged state and the guide in a media pressing position according to an example embodiment.
Figure 8:
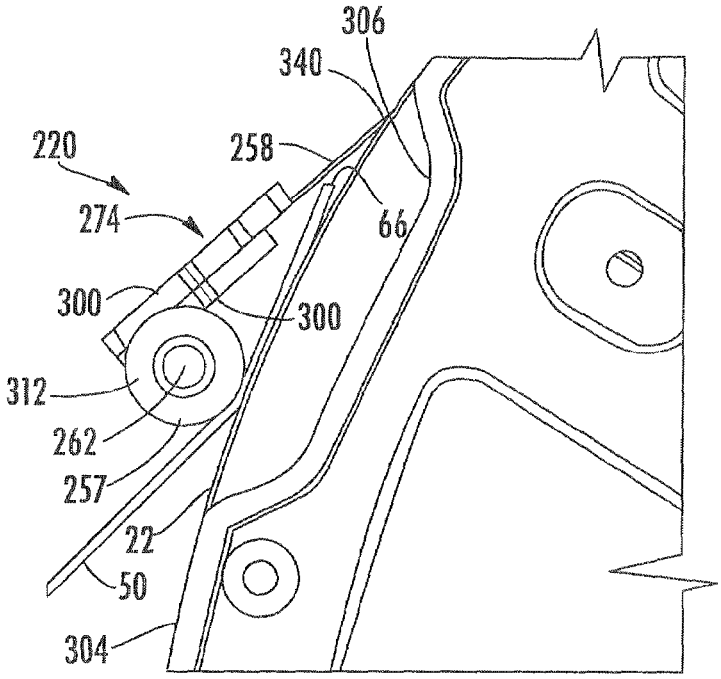
FIG. 8 is a sectional view of the printing system of FIG. 7 illustrating the guide in the media pressing position according to an example embodiment.
Figure 9:
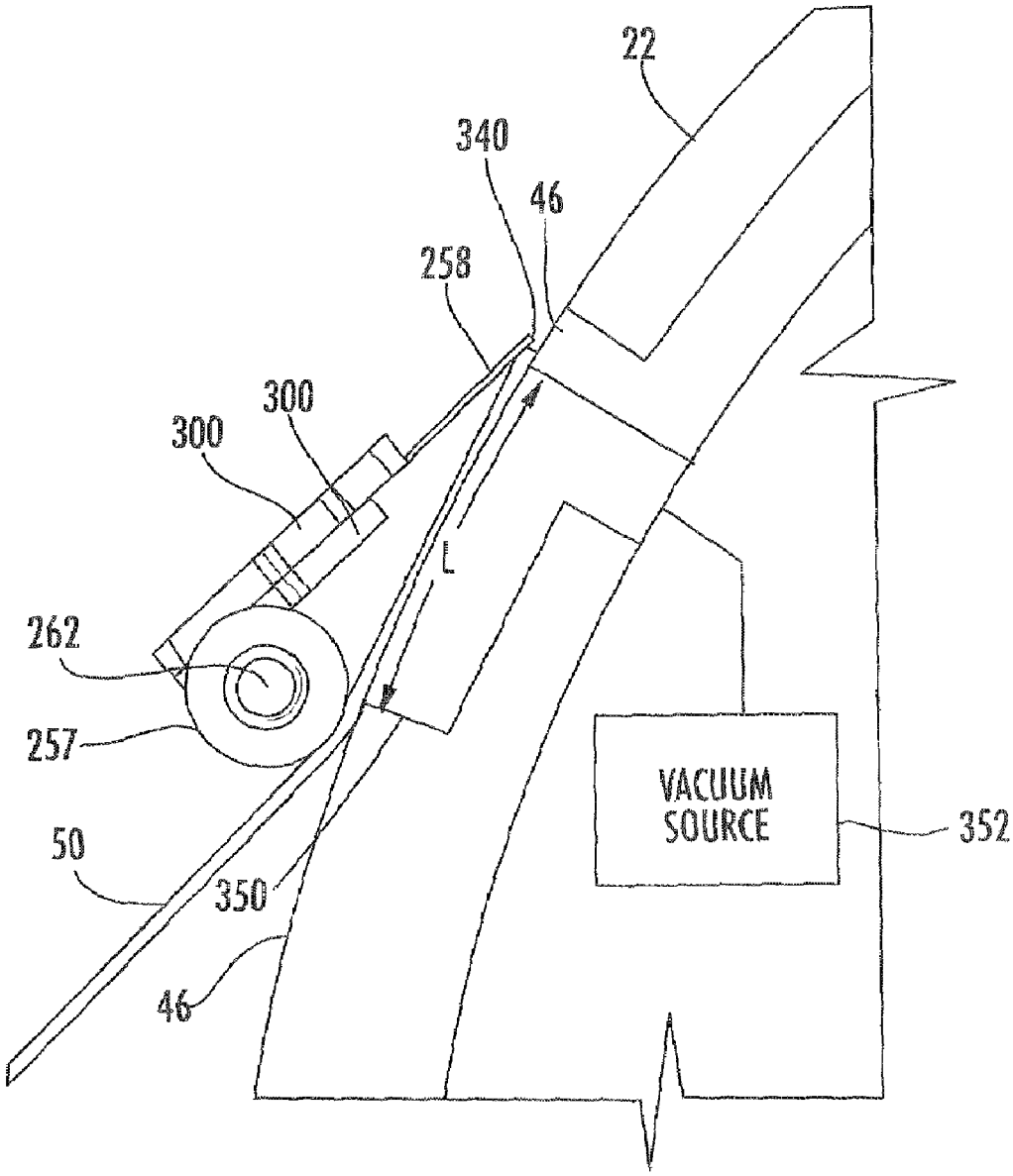
FIG. 9 is a sectional view of the printing system of FIG. 7 illustrating the guide in the media pressing position according to an example embodiment.

FIGS. 7-9 illustrate repositioning of cam 270 such that guide 258 is moved to the media pressing position. As shown by FIG. 7, sheet 50 is loaded onto drum 22 at a location such that wheel 310 of cam follower 272 engages portion 306 just prior to arrival of leading edge 66 of sheet 50. As a result of wheel 310 engaging portion 306, bias 322 urges arm 312 and guide 258 in a clockwise direction as seen in FIG. 7 to move guide 258 towards surface 46. In one embodiment, cam follower wheel 310 engages portion 306 and lowers guide 258 into contact with surface 340 approximately 6 mm ahead of an oncoming sheet 50 as seen in FIG. 8. In the embodiment illustrated, wheel 310 remains in portion 306 for approximately 1 inch after leading edge 66 of sheet 50 has passed tip 340 of media guide 258. In other embodiments, these relationships may be varied.

As shown in FIG. 9, in those embodiments in which surface 46 includes vacuum ports 350 (one of which is shown) having a circumferential length L and through which a vacuum is applied by a vacuum source 352 (schematically shown), guide 258 has a tip 340 separated from axis 262 by distance greater than or equal to a circumferential length L. In one embodiment, the combination of media guide bar 257 and guide 258 force the first 32 mm of sheet 50 into contact with surface 46. As a result, sheet 50 is pressed against and across port 350 so as to seal the channel or port 350 below surface 46. This enhances the hold-down vacuum force created by vacuum source 352 and ports 350. As a result, sheet 50 is more securely retained and held against surface 46 after loading.

Figure 10:
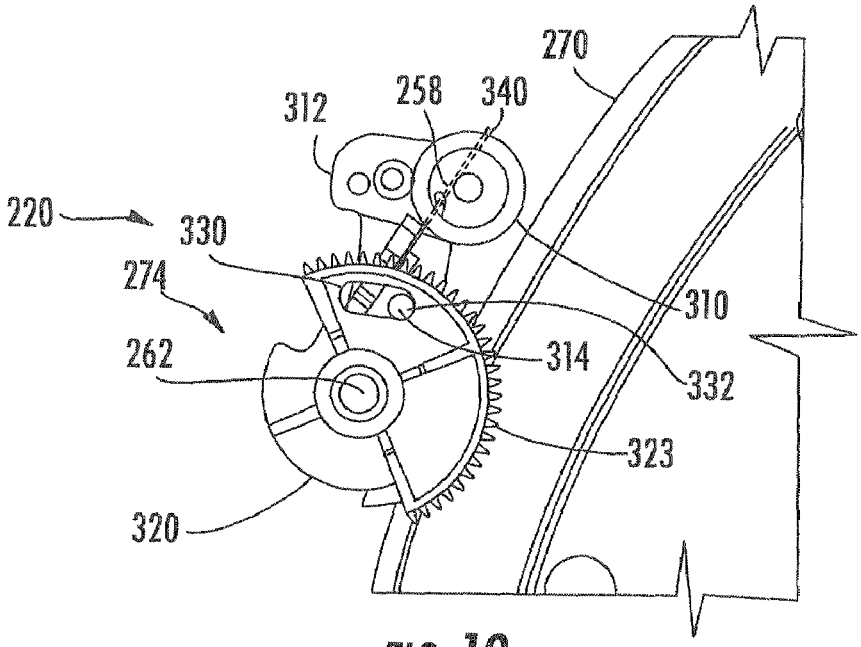
FIG. 10 is an enlarged fragmentary side elevational view of the printing system of FIG. 3 illustrating the cam follower in a cam disengaged state and the guide in a first retracted position according to an example embodiment.
Figure 11:
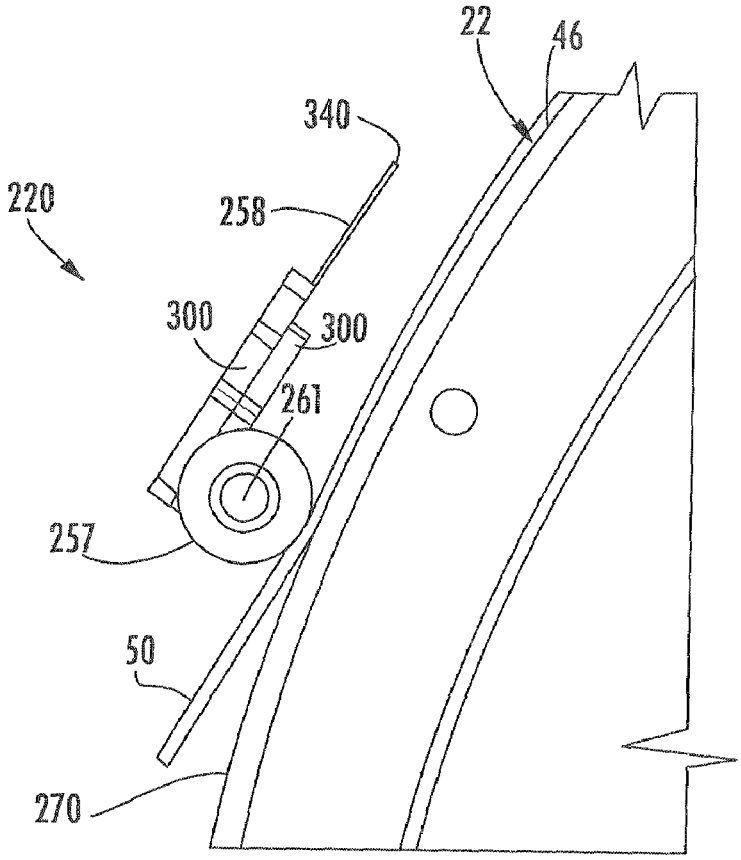
FIG. 11 is a sectional view of the printing system of FIG. 10 illustrating the guide in the first retracted position according to an example embodiment.

FIGS. 10 and 11 illustrate actuator 274 moving cam follower 272 to a first cam disengaged state. In particular, as shown in FIG. 10, controller 238 (shown in FIG. 3) generates control signals directing rotary actuator 326 (shown in FIG. 6) to drive or rotate rotational structure 320 counter-clockwise from the follower releasing state shown in FIG. 4 to the follower driving state shown in FIG. 10. When in the follower driving state in which surface 332 contacts pin 314, rotation of rotational structure 320 in the counter-clockwise direction rotates arm 312 in the counter-clockwise direction about axis 262. As a result, wheel 310 is lifted to a cam disengaged state. This also results in arm 312 engaging and pivoting guide 258 about axis 262 to a first retracted position. As shown by FIG. 10, cam follower wheel 310 remains relatively close to cam 270, ready to quickly engage upon loading of another sheet 50. As shown by FIG. 1, in the first retracted position, guide 258 is sufficiently spaced from surface 46 such that sheet 50 may pass beneath guide 258 without contact with guide 258.

Figure 12:
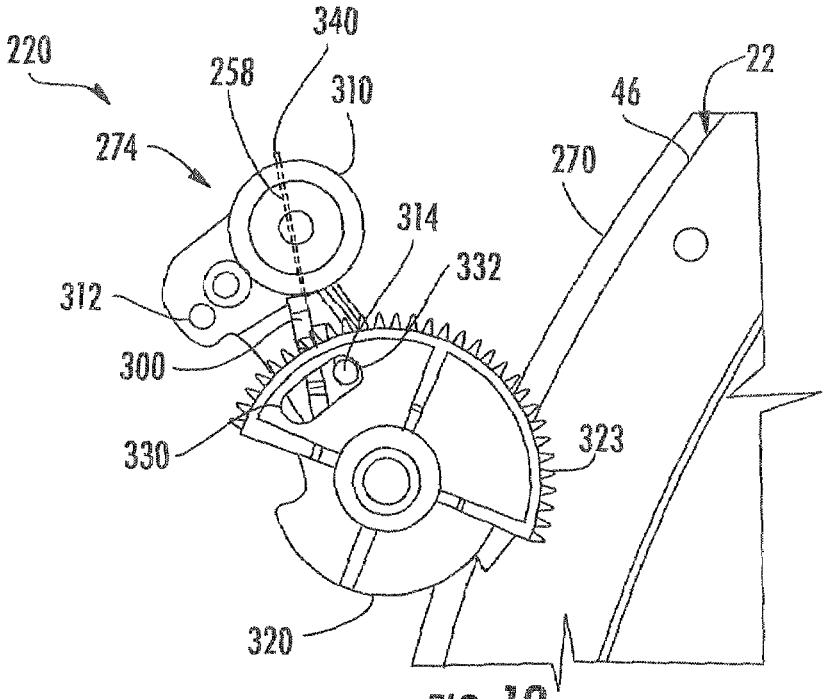
FIG. 12 is an enlarged fragmentary side elevational view of the printing system of FIG. 3 illustrating the cam follower in a second cam disengaged state and the guide in a second retracted position according to an example embodiment.
Figure 13:
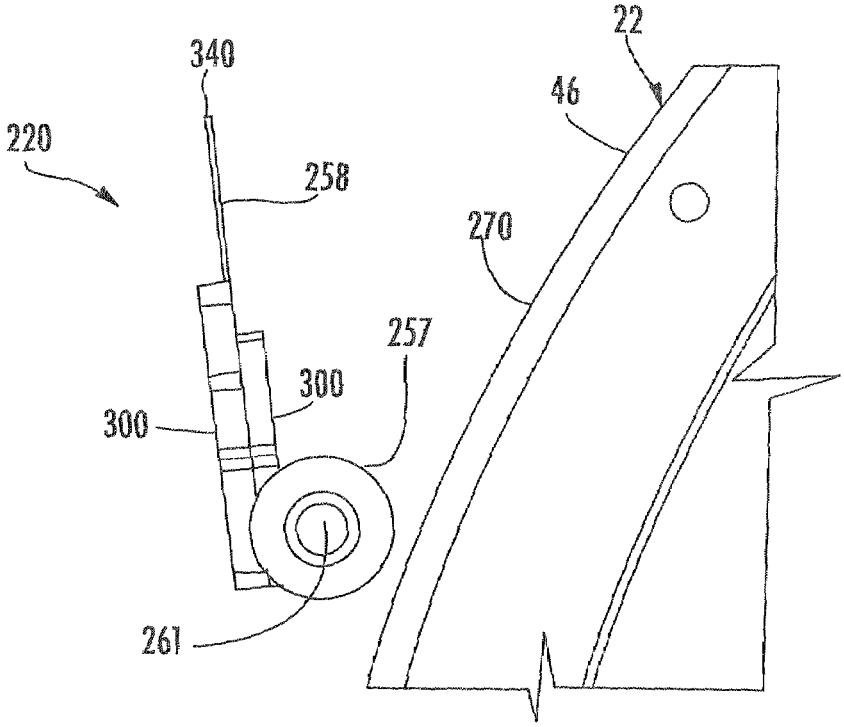
FIG. 13 is a sectional view of the printing system of FIG. 12 illustrating the guide in the second retracted position according to an example embodiment.

FIGS. 12 and 13 illustrate actuator 274 moving cam follower 272 and media guide 258 to a second retracted position spaced further from surface 46 or other user interactions. In particular, controller 238 (shown in FIG. 3) generates control signals causing Rotary actuator 326 to drive rotational structure 320 further counter-clockwise from the position shown in FIG. 10 to the position shown in FIG. 12. Such rotation moves wheel 310 and guide 258 further away from surface 46, facilitating paper or media jam removal. To return cam follower 272 to the first cam disengaged state or the cam engaged state described above and to also move guide 258 towards the first retracted position or towards a media pressing position, controller 238 generates control signals causing rotary actuator 326 to drive rotational structure 320 in a clockwise direction.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a rotational drum having a circumferential surface configured to support a medium; and a guide movable between a first position in which the guide is configured to press the medium towards the circumferential surface and at least one second position further retracted from the circumferential surface than the first position, wherein the guide is supported independent of the drum such that the drum is rotatable relative to the guide while the guide is in the first position to move the medium relative to the guide while the guide is in the first position;

a guide actuation mechanism configured to move the guide between the first position and the second position based upon an angular positioning of the circumferential surface, wherein the guide actuation mechanism comprises:

a cam surface coupled to the drum to rotate with the drum; and a cam follower coupled to the guide and in engagement with the cam surface, wherein the cam follower is configured to engage the cam during rotation of the drum to move the guide relative to the circumferential surface; and an actuator configured to move the cam follower between a cam engaged state and a cam disengaged state, wherein the actuator is configured to move the cam follower to and hold the cam follower at a first retracted position spaced from the cam a first distance and to move the cam follower to and hold the cam follower at a second retracted position spaced from the cam a second distance less than the first distance.

2. The apparatus of claim 1 wherein the actuator comprises:

a rotational structure rotatable between a follower driving state in driving engagement with the follower and a releasing state out of driving engagement with the follower; and a rotary actuator configured to rotate the structure between the driving state and the releasing state.

3. The apparatus of claim 2, wherein the rotary actuator is configured to rotate the structure in a first direction to the follower driving state and in a second opposite direction to the releasing state.

4. The apparatus of claim 2 further comprising:

one of a projection and a detent coupled to the cam follower and the other of the projection and the detent coupled to the rotational structure, wherein the projection and the detent are in engagement when the rotational structure is in the driving state and are out of engagement when the rotational structure is in the releasing state.

5. The apparatus of claim 1 further comprising a guide actuation mechanism configured to move the guide to the first position at a first time proximate to loading of a medium against the surface and to return the guide to the second position at a second subsequent time.

6. The apparatus of claim 1 further comprising a hold-down mechanism configured to hold the medium against the surface.

7. The apparatus of claim 1 further comprising:

a vacuum port along the surface; and a vacuum source in pneumatic communication with the vacuum port.

8. The apparatus of claim 7, wherein the vacuum port has a circumferential length, wherein the guide pivots about an axis and wherein the guide has a tip spaced from the axis a distance greater than or equal to the circumferential length.

9. The apparatus of claim 8 further comprising a media guide bar along the axis and spaced from the circumferential surface by less than or equal to about 2 mm.

10. The apparatus of claim 1 further comprising a print device configured to deposit printing material on a medium that is held against the circumferential surface.

11. An apparatus comprising:

a rotational drum having a circumferential surface configured to support a medium; and a guide movable between a first position in which the guide is configured to press the medium towards the circumferential surface and at least one second position further retracted from the circumferential surface than the first position, wherein the guide is supported independent of the drum such that the drum is rotatable relative to the guide while the guide is in the first position to move the medium relative to the guide while the guide is in the first position;

a guide actuation mechanism configured to move the guide between the first position and the second position based upon an angular positioning of the circumferential surface, wherein the guide actuation mechanism comprises:

a cam surface coupled to the drum to rotate with the drum; and a cam follower coupled to the guide and in engagement with the cam surface, wherein the cam follower is configured to engage the cam during rotation of the drum to move the guide relative to the circumferential surface; and an actuator configured to move the cam follower between a cam engaged state and a cam disengaged state, wherein the actuator comprises:

a rotational structure rotatable between a follower driving state in driving engagement with the follower and a releasing state out of driving engagement with the follower; and a rotary actuator configured to rotate the structure between the driving state and the releasing state.

12. The apparatus of claim 11, wherein the rotary actuator is configured to rotate the structure in a first direction to the follower driving state and in a second opposite direction to the releasing state.

13. The apparatus of claim 11 further comprising:

one of a projection and a detent coupled to the cam follower and the other of the projection and the detent coupled to the rotational structure, wherein the projection and the detent are in engagement when the rotational structure is in the driving state and are out of engagement when the rotational structure is in the releasing state.

* * * * *

UNITED STATES PATENT AND TRADEMARK OFFICE

CERTIFICATE OF CORRECTION

PATENT NO. : 7,594,657 B2
APPLICATION NO. : 11/669484
DATED : September 29, 2009
INVENTOR(S) : Robert M. Yraceburu et al.

It is certified that error appears in the above-identified patent and that said Letters Patent is hereby corrected as shown below:

In column 13, line 66, in Claim 2, after "Claim 1" insert -- , --.

Signed and Sealed this

Ninth Day of November, 2010

David J. Kappos

David J. Kappos
*Director of the United States Patent and Trademark Office*